US008548360B2

(12) United States Patent
Liu

(10) Patent No.: US 8,548,360 B2
(45) Date of Patent: Oct. 1, 2013

(54) TONER CARTRIDGE CONVERTING DEVICE

(75) Inventor: Shi-Ze Liu, Taipei County (TW)

(73) Assignees: Cal-Comp Electronics & Communications Company Limited, New Taipei (TW); Kinpo Electronics, Inc., New Taipei (TW)

( * ) Notice: Subject to any disclaimer, the term of this patent is extended or adjusted under 35 U.S.C. 154(b) by 168 days.

(21) Appl. No.: 12/969,591

(22) Filed: Dec. 16, 2010

(65) Prior Publication Data

US 2011/0293334 A1 Dec. 1, 2011

(30) Foreign Application Priority Data

May 27, 2010 (TW) ..... 99117035 A

(51) Int. Cl.
*G03G 15/01* (2006.01)
*G03G 15/00* (2006.01)

(52) U.S. Cl.
USPC ..... 399/228; 399/167

(58) Field of Classification Search
USPC ..... 399/228, 167
See application file for complete search history.

(56) References Cited

U.S. PATENT DOCUMENTS 2,779,306 A * 1/1957 Dunn ..... 118/303
5,495,327 A * 2/1996 Inomata ..... 399/228
5,615,002 A * 3/1997 Haneda et al. ..... 399/227
5,761,580 A * 6/1998 Harada et al. ..... 399/167
6,104,898 A * 8/2000 Awano et al. ..... 399/119
6,188,857 B1 * 2/2001 Yamanaka et al. ..... 399/167
2003/0129003 A1 * 7/2003 Yoo ..... 399/228
2003/0161663 A1 * 8/2003 Yanagida ..... 399/167
2008/0145112 A1 * 6/2008 Bessette ..... 399/263
2008/0205911 A1 * 8/2008 Ishikawa et al. ..... 399/12
2009/0022521 A1 * 1/2009 Keilty et al. ..... 399/228

FOREIGN PATENT DOCUMENTS

JP 07057385 A * 3/1995
JP 200291162 3/2002
TW 200705139 2/2007
TW 200902325 1/2009

OTHER PUBLICATIONS

"Office Action of Taiwan Counterpart Application", issued on Jun. 13, 2013, p1-p5, in which the listed reference was cited.

* cited by examiner

*Primary Examiner* — Walter L Lindsay, Jr.
*Assistant Examiner* — Rodney Bonnette
(74) *Attorney, Agent, or Firm* — Jianq Chyun IP Office

(57) ABSTRACT

A toner cartridge converting device is provided with a driving module to change gaps between a photoreceptor drum and respective toner cartridges using a positioning groove formed in a radial direction of the photoreceptor drum. Each fixing rod of the toner cartridges can slide into the positioning groove and slide out of the positioning groove with following the displacement of the groove, so that the converting operation to the toner cartridges can be finished. Due to the configuration space required by the driving module is smaller, and the quantity of elements is less than the conventional driving unit and easy in repair and maintenance, so that the structure of the driving module is simplified and the repair cost is reduced.

3 Claims, 3 Drawing Sheets

TONER CARTRIDGE CONVERTING DEVICE

CROSS-REFERENCE TO RELATED APPLICATION

This application claims the priority benefit of Taiwan application serial no. 99117035, filed on May 27, 2010. The entirety of the above-mentioned patent application is hereby incorporated by reference herein and made a part of this specification.

BACKGROUND OF THE INVENTION

1. Field of the Invention

The present invention generally relates to a printer, and more particularly, to a toner cartridge converting device of a printer.

2. Description of Related Art

Along with gradually reduced price of a laser printer and an inkjet printer and the printing effect with high quality, the laser printers or the inkjet printers have gradually become an indispensable electronic product with personal or home. In particular, the photo printing function by using a printer has matched the level of any professional photo library store and makes the personal photo, color/black-white image files more close true color and more vivid. On the other hand, through a high transmission speed interface (for example, USB interface), the printing by a printer for large dimension and high resolution images is largely speeded up so that a user can more conveniently and more effectively accomplish the printing job of a high quality photo.

In terms of a laser printer, a toner supply unit makes toner adhered onto a photoreceptor drum so as to produce an image thereon. The operation principle herein is that a laser light irradiates the photoreceptor drum, then electrical potential differences are formed on the photoreceptor drum to produce an electrostatic latent image, and the electrical potential differences are used to attract toner so that the above-mentioned electrostatic latent image is transfer printed on a paper. However, the above-mentioned toner supply unit requires a driving unit including a motor, a set of gears and a rack, which makes four toner cartridges for four colors (yellow, magenta, cyan and black, briefed as YMCK) fixed on the circum surface of the rack and drives the motor and the set of gears so that the mechanical structure and the operation are quite complicated. As a result, the driving unit based on the above-mentioned principle is quite expensive. A singular driving unit occupies a high percentage of the total cost of a laser printer. Therefore, it is really needed to further simplify the mechanical structure and reduce the maintenance cost.

SUMMARY OF THE INVENTION

Accordingly, the present invention is directed to a toner cartridge converting device for simplifying the mechanical structure and reducing the maintenance cost.

The present invention provides a toner cartridge converting device suitable for a printer. The device includes a photoreceptor drum, a toner supply unit and a driving module. The circum surface of the photoreceptor drum forms an electrostatic latent image. In association with the rotation of the photoreceptor drum, the toner supply unit provides toners on the electrostatic latent image and has a plurality of toner cartridges adjacent to the circum surface of the photoreceptor drum. The driving module is disposed at a side of the photoreceptor drum which is the same as that of the toner supply unit sequentially makes the toner cartridges relatively move along the radial direction of the photoreceptor drum in association with the rotation of the photoreceptor drum, wherein the driving module includes an operation part for leaning against the toner cartridges, the operation part has a positioning groove formed along the radial direction of the photoreceptor drum so that one toner cartridge located in the positioning groove can be more adjacent to the circum surface of the photoreceptor drum than other toner cartridges.

In an embodiment of the present invention, the above-mentioned operation part is a rotation disc, wherein the positioning groove is formed on the ring-like surface of the rotation disc.

In an embodiment of the present invention, the above-mentioned driving module further includes a belt for driving the rotation disc to rotate in the rotating direction of the photoreceptor drum.

In an embodiment of the present invention, the above-mentioned operation part is a hollow rotation disc, wherein the positioning groove is formed on an outer-ring-like surface of the hollow rotation disc and an inner-ring-like surface of the hollow rotation disc has a plurality of protrusive teeth.

In an embodiment of the present invention, the above-mentioned driving module further has a gear, wherein the gear is located at the inner side of the hollow rotation disc, the gear is engaged with the protrusive teeth to drive the hollow rotation disc for rotation in the rotating direction of the photoreceptor drum.

In an embodiment of the present invention, the above-mentioned operation part is a rotation disc, wherein the positioning groove is formed on an outer-ring-like surface of the rotation disc and the outer-ring-like surface of the rotation disc has a plurality of protrusive teeth.

In an embodiment of the present invention, the above-mentioned driving module further includes a gear, wherein the gear is located at the outer side of the rotation disc, the gear is engaged with the protrusive teeth to drive the rotation disc to rotate in the rotating direction of the photoreceptor drum.

In an embodiment of the present invention, the above-mentioned operation part is a rectangular bar, wherein the positioning groove is formed on a side surface of the rectangular bar, and the side surface is relatively far away from the photoreceptor drum and the moving direction of the rectangular bar is perpendicular to the moving direction of the toner cartridges.

In an embodiment of the present invention, the above-mentioned toner cartridges are sequentially being positioned in the positioning groove in association with the position variations by using a fixing rod.

In an embodiment of the present invention, the above-mentioned positioning groove is a V-shaped notch.

Based on the depiction above, the present invention uses the positioning groove located along the radial direction of the photoreceptor drum to change the gaps between the photoreceptor drum and the toner cartridges respectively, and further completing conversion operation of the toner cartridge by means of the position variations of the positioning groove which makes the fixing rods of the toner cartridges sequentially to slide into and then slide out of the positioning groove. Since the configuration space required by the driving module of the present invention is smaller and the quantity of the required parts is much less than the quantity in the conventional driving unit, so that the mechanical structure of the driving unit is simplified and the maintenance cost is reduced.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
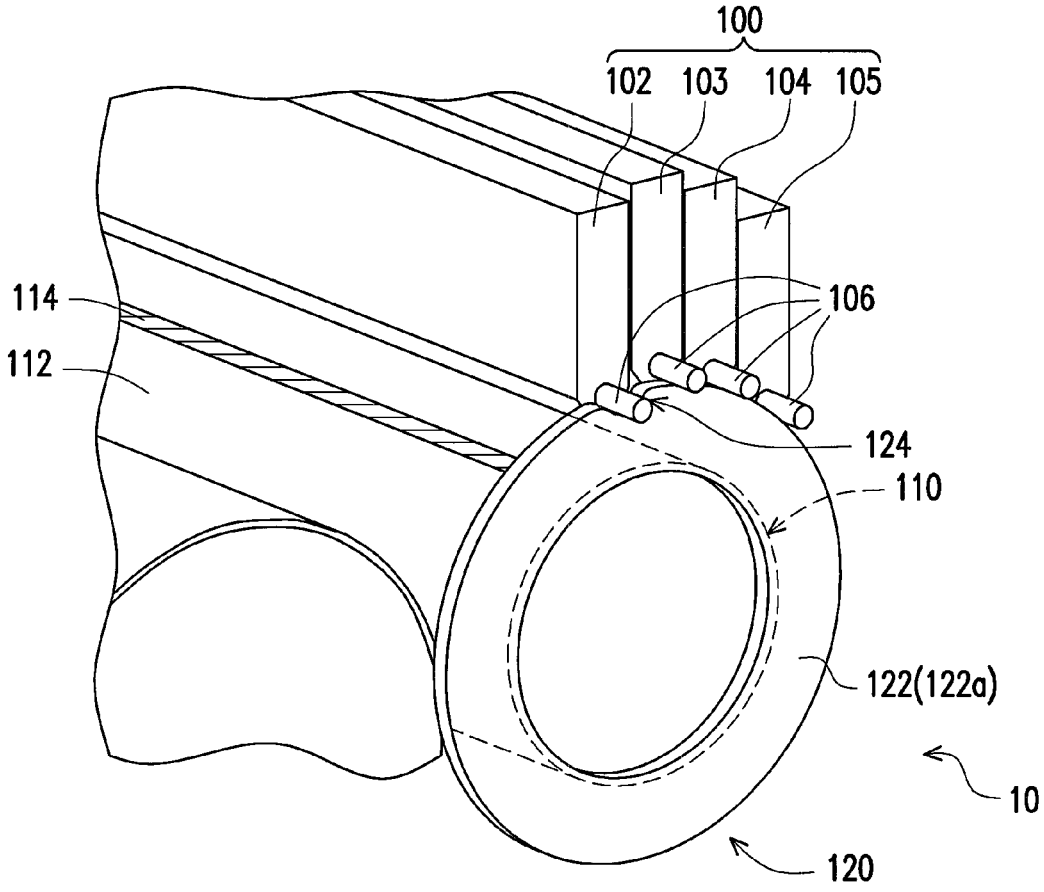
FIG. 1 is an assembly diagram of a toner cartridge converting device according to the first embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

Figure 2:
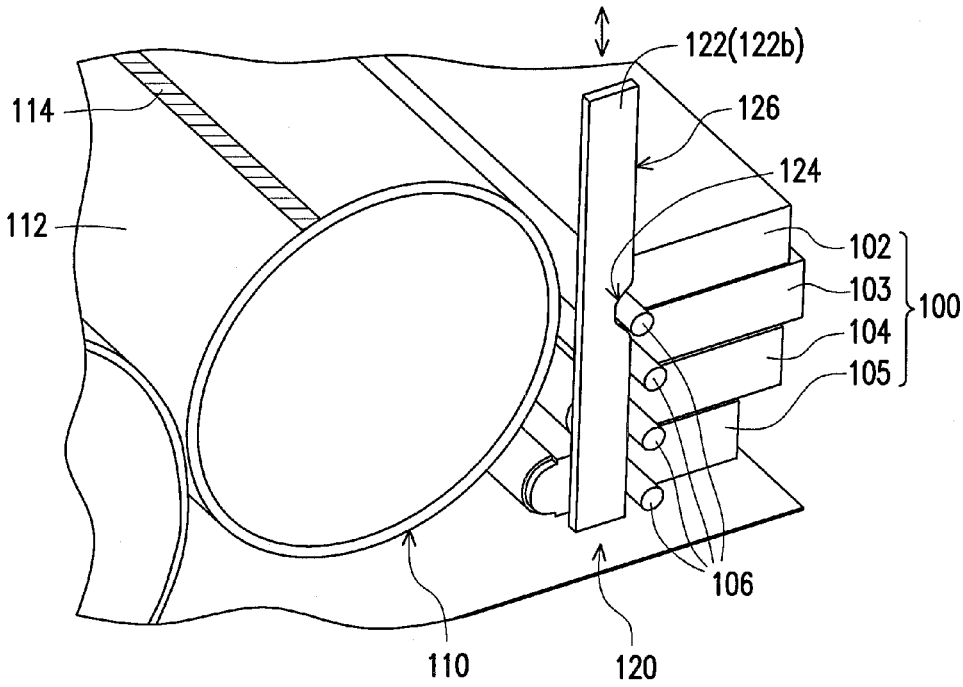
FIG. 2 is an assembly diagram of a toner cartridge converting device according to the second embodiment of the present invention.

FIG. 1 is an assembly diagram of a toner cartridge converting device according to the first embodiment of the present invention. FIG. 2 is an assembly diagram of a toner cartridge converting device according to the second embodiment of the present invention.

Referring to FIG. 1, a toner cartridge converting device 10 of the embodiment can be applied in laser printers with various light-sensing types or other printers by using a photoreceptor drum 110 to transfer print images, wherein a toner supply unit 100 composed of a plurality of toner cartridges 102-105 includes, for example, toner cartridges of four colors (yellow, magenta, cyan and black, briefed as YMCK). The toner cartridges 102-105 are adjacent to the circum surface 112 of the photoreceptor drum 110 and keep appropriate gaps from the circum surface 112 of the photoreceptor drum 110, for example, 2-3 cm. The toner supply unit 100 can sequentially provide toners with different colors on the photoreceptor drum 110 in association with the rotation of the photoreceptor drum 110. In short, the photoreceptor drum 110 rotates following a certain direction (in the embodiment, rotating in the clockwise direction) in association with the paper-feeding direction. After charging, a layer with even charges is formed on the surface of the photoreceptor drum 110, followed by exposing; then, electrical potential differences are formed on the surface of the photoreceptor drum, i.e., an electrostatic latent image 114 is formed on the circum surface 112. When the toner contacts the circum surface 112 of the photoreceptor drum 110, due to the electric field, an image is formed on the surface of the photoreceptor drum 110. As a result, when the area with electrostatic charges on the surface of the photoreceptor drum 110 passes through the toner supply unit 100, the toner provided by the toner supply unit 100 would be attracted and adhered onto the area with higher electrostatic levels on the photoreceptor drum 110.

In order to simplify the mechanical structure and the operation of the toner cartridge converting device 10 in a printer, a driving module 120 is disposed at a side of the toner supply unit 100 in this embodiment, so that the steps of the mechanical operation can be simplified with the minimum quantity of the parts and the configuration space required by the driving module 120 can be reduced to the smallest, which is advantageous in reducing the inside space of the printer. As shown by FIG. 1, the driving module 120 includes an operation part 122 leaning against the toner cartridges 102-105, wherein the operation part 122 is, for example, a rotation disc 122*a* disposed at a side of the photoreceptor drum 110 which is the same as that of the toner supply unit 100. The center point of the rotation disc 122*a* can be located on the axial direction of the photoreceptor drum 110. The radius of the rotation disc 122*a* is slightly greater than the radius of the photoreceptor drum 110, and so that the fixing rods 106 of the four toner cartridges 102-105 can be elastically leaned against the ring-like surface of the rotation disc 122*a*. The bottom portion of each of the toner cartridges 102-105 still keeps an appropriate gap from the circum surface 112 of the photoreceptor drum 110, for example, 2.1-3 cm. It should be noted that the ring-like surface of the rotation disc 122*a* has a positioning groove 124 thereon, wherein the grove is, for example, a V-shaped notch with a dent towards the radial direction of the photoreceptor drum 110, and the dimension of the notch is slightly greater than the depth thereof and the bottom surface of the positioning groove 124 is preferred to be a arc surface. The depth of the positioning groove 124 can be 1-2 cm. When the photoreceptor drum 110 is driven by a motor (not shown) and rotates, the rotation disc 122*a* can rotate an angle in association with the rotation of the photoreceptor drum 110. For example, when the photoreceptor drum 110 rotates a turn) (360°, the rotation disc 122*a* can clockwise or anticlockwise rotate an angle (for example, 20°) in association with the rotation of the photoreceptor drum 110, and analogically for the rest. Whenever the rotation disc 122*a* rotates an angle, the position of the positioning groove 124 is changed therewith. Then, by means of the position variation of the positioning groove 124, the fixing rod 106 of one of the four toner cartridges 102-105 would be located in the positioning groove 124 until the rotation disc 122*a* rotates the next angle. At the time, the fixing rod 106 of the toner cartridge 102 originally located in the positioning groove 124 would consequently slide out of the positioning groove 124, while the fixing rod 106 of another toner cartridge 103 would rightly consequently slide into the positioning groove 124 along an inclined surface. In this way, a conversion operation of the toner cartridges 102-105 is accomplished.

In addition, as shown by FIG. 2, the operation part 122 leaning against the four toner cartridges 102-105 can be a rectangular bar 122*b*, which is located at a side of the photoreceptor drum 110 which is the same as that of the toner supply unit 100. The length of the rectangular bar 122*b* can be larger than the radius of the photoreceptor drum 110 or the diameter of the photoreceptor drum 110, so that when the fixing rods 106 of the four toner cartridges 102-105 are elastically leaned against an outside surface 120 of the rectangular bar 122*b* relatively far away from the photoreceptor drum 110, the bottom portion of each of the toner cartridges 102-105 still keeps an appropriate gap from the circum surface 112 of the photoreceptor drum 110. It should be noted that the side surface 126 of the rectangular bar 122*b* has a positioning groove 124 thereon which is, for example, a V-shaped notch with a dent towards the radial direction of the photoreceptor drum 110. The dimension of the notch is slightly greater than the depth thereof and the bottom surface of the positioning groove 124 is preferably a arc surface. The depth of the positioning groove 124 can be 1-2 cm. The unique of the embodiment from the rotation disc 122*a* in the above-mentioned first embodiment is that the rotation disc 122*a* rotates clockwise or anticlockwise, the rectangular bar 122*b* moves straightly in the longitudinal direction thereof and the moving direction of the rectangular bar 122*b* is perpendicular to the moving direction of the toner cartridges 102-105 (along the radial direction of the photoreceptor drum 110). In response to the rotation of the photoreceptor drum 110, the rectangular bar 122*b* moves a segment distance each time to change the position of the positioning groove 124. As a result, the fixing rods 106 of the toner cartridges 102-105 sequentially slide into or out of the positioning groove 124 to accomplish a conversion operation of the toner cartridges 102-105.

In the above-mentioned embodiments, a toner cartridge 102 located in the positioning groove 124 is more adjacent to the circum surface 112 of the photoreceptor drum 110 than other the toner cartridges 103-105, so that the toner provided by the toner cartridge 102 is attracted and adhered onto the electrostatic latent image 114 of the photoreceptor drum 110 until all the four toner cartridges 102-105 sequentially complete the above-mentioned operation steps. At the point, the toner adhered on the photoreceptor drum 110 is transferred on a paper by a transfer-writing belt. Next, performing a high-pressure and high temperature process on the feeding paper to fix the toner transferred onto the paper on the paper. Since there might be residue toner on the surface in the area after being transferred of the photoreceptor drum 110, so that a toner-removing unit (not shown) is needed to remove the residue toner. After that, the area after the toner is removed is processed by an electrostatic-charge-removing unit (not shown) so as to remove the electrostatic charges from the surface of the photoreceptor drum 110, wherein the electrostatic-charge-removing unit can be an enhanced exposing light source, and the electrostatic effect of the area irradiated by the enhanced exposing light source is eliminated. When the photoreceptor drum 110 restores to its initial status, an even electrostatic field is established on the surface of the photoreceptor drum 110 so that the light source can form another electrostatic latent image 114 on the surface of the photoreceptor drum 110 for attracting and adhering the toner and the toner is transferred on another paper then.

Figure 3:
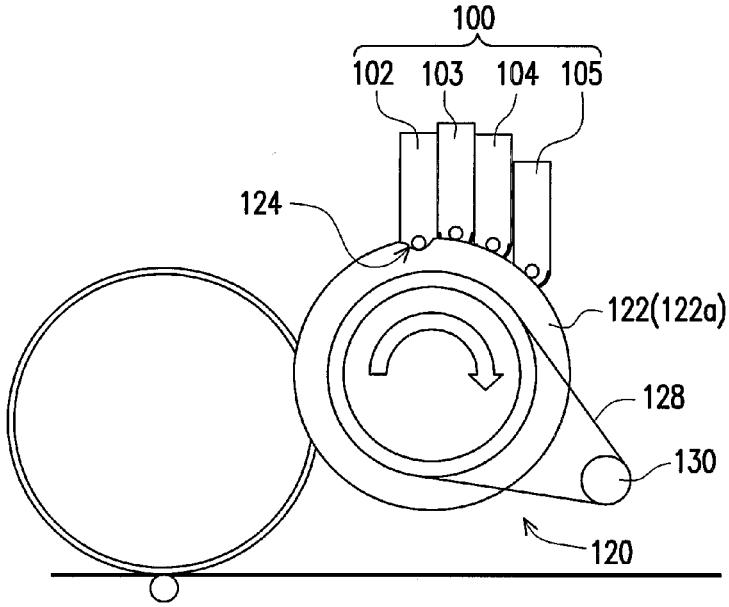
FIGS. 3, 4 and 5 are diagrams respectively showing three driving types of the driving module in the first embodiment.
Figure 4:
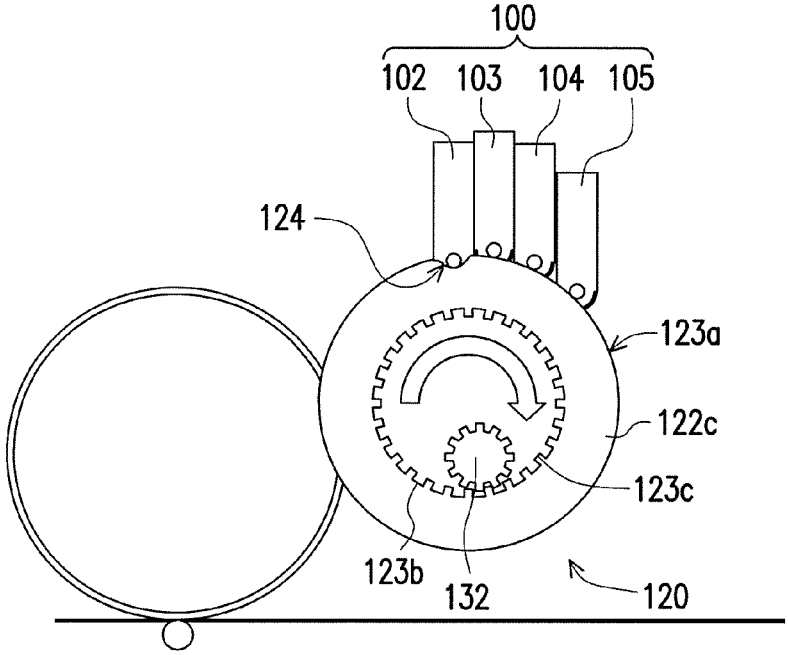
Figure 5:
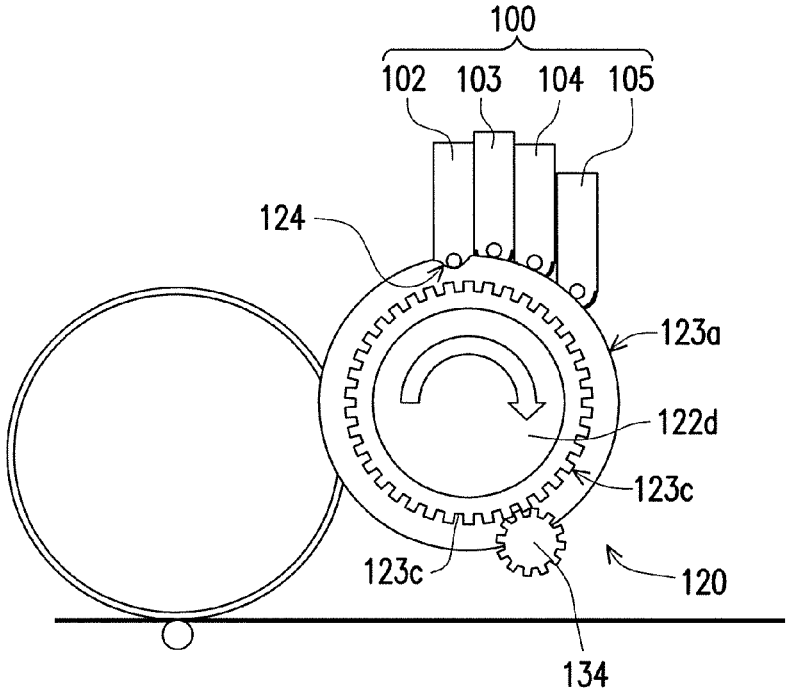

FIGS. 3, 4 and 5 are diagrams respectively showing three driving types of the driving module 120 in the first embodiment. In FIG. 3, the driving module 120 can surround the external surface of the rotation disc 122*a* through a belt 128. Another end of the belt 128 surrounds a pulley 130 to keep belt tension. The belt 128 drives the rotation disc 122*a* to rotate in the rotating direction of the photoreceptor drum 110 (for example, clockwise rotation). In FIG. 4, the driving module 120 drives a hollow rotation disc 122*c* to rotate in the rotating direction of the photoreceptor drum 110 (for example, clockwise rotation) through that a gear 132 disposed at the inner side of the hollow rotation disc 122*c* is engaged with a plurality of protrusive teeth 123*c* on an inner-ring-like surface 123*b* of the hollow rotation disc 122*c*. The positioning groove 124 is formed on an outer-ring-like surface 123*a* of the hollow rotation disc 122*c*. In FIG. 5, the driving module 120 drives a rotation disc 122*d* to rotate in the rotating direction of the photoreceptor drum 110 (for example, clockwise rotation) through that a gear 134 disposed at the outer side of the rotation disc 122*d* is engaged with a plurality of protrusive teeth 123*c* on an outer-ring-like surface 123*a* of the rotation disc 122*d*. The rotation disc 122*d* in FIG. 5 is not limited to a hollow one, and it can be a solid rotation disc.

In summary, the positioning groove formed in the radial direction of the photoreceptor drum is used for changing the gap between the photoreceptor drum and each of the toner cartridges in the present invention. By changing the position of the positioning groove, the fixing rods of the toner cartridges sequentially slide into and then out of the positioning groove so as to accomplish the conversion operation of the toner cartridges. Since the configuration space required by the driving module of the present invention is smaller and the quantity of the required parts is much less than the quantity in the conventional driving unit, so that the mechanical structure of the driving unit is simplified and the maintenance cost is reduced.

It will be apparent to those skilled in the art that the descriptions above are several preferred embodiments of the present invention only, which does not limit the implementing range of the present invention. Various modifications and variations can be made to the structure of the present invention without departing from the scope or spirit of the invention.

What is claimed is:

1. A toner cartridge converting device, comprising:

a photoreceptor drum, wherein an electrostatic latent image is formed on the circum surface of the photoreceptor drum;

a toner supply unit, providing toners on the electrostatic latent image in association with the rotation of the photoreceptor drum and having a plurality of toner cartridges adjacent to the circum surface of the photoreceptor drum; and a driving module, disposed at a side of the photoreceptor drum which is the same as that of the toner supply unit and sequentially making the toner cartridges relatively move along a radial direction of the photoreceptor drum in association with the rotation of the photoreceptor drum, wherein the driving module comprises a rectangular bar serving as an operation part for leaning against the toner cartridges and the moving direction of the rectangular bar is perpendicular to the moving direction of the toner cartridges, the operation part has a positioning groove formed on an side surface relatively far away from the photoreceptor drum so that a toner cartridge located in the positioning groove is more adjacent to the circum surface of the photoreceptor drum than other toner cartridges.

2. The toner cartridge converting device as claimed in claim 1, wherein the toner cartridges are sequentially positioned in the positioning groove in association with the position variations of the positioning groove by using a fixing rod respectively.

3. The toner cartridge converting device as claimed in claim 1, wherein the positioning groove is a V-shaped notch.

* * * * *